US007587781B2

(12) United States Patent
Vales

(10) Patent No.: US 7,587,781 B2
(45) Date of Patent: Sep. 15, 2009

(54) PAINTBRUSH WITH ADJUSTABLE HEAD

(75) Inventor: Robert Raymond Vales, Pittsburgh, PA (US)

(73) Assignee: Shara Danette Vales, Pittsburgh, PA (US)

( * ) Notice: Subject to any disclaimer, the term of this patent is extended or adjusted under 35 U.S.C. 154(b) by 765 days.

(21) Appl. No.: 11/365,152

(22) Filed: Mar. 1, 2006

(65) Prior Publication Data

US 2007/0204418 A1 Sep. 6, 2007

(51) Int. Cl.
*B25G 1/06* (2006.01)

(52) U.S. Cl. ..... 15/144.1; 15/172; 16/900; 81/177.8; 403/97

(58) Field of Classification Search ..... 15/143.1, 15/144.1, 172, 201, 203, 185; 16/900, 249, 16/422, 430; 81/177.8; 403/96, 97, 91
See application file for complete search history.

(56) References Cited

U.S. PATENT DOCUMENTS 3,273,192 A * 9/1966 Mazzella ..... 15/230.11
5,502,859 A * 4/1996 Kim ..... 15/144.1
6,155,620 A * 12/2000 Armstrong ..... 294/57
6,301,740 B1 * 10/2001 Quiroz ..... 15/172
7,472,447 B2 * 1/2009 Lougheed ..... 15/144.1

* cited by examiner

*Primary Examiner*—Gary K Graham

(57) ABSTRACT

A paintbrush comprising of a tubular handle (11), forged male slip/snap locking wheel (10) at top of handle (11), and a brush head (3) with two embedded forged female slip/snap locking wheels, with one female at bottom of brush head (3) marked (6) and the other marked (4) on face of brush head (3). These slip/snap locking wheels allow the user to adjust the paintbrush to paint various angles through rotation extending one-hundred and eighty degrees (180°). The tubular handle (11) also has a bottom/rear female thread (12) to accept a standard universal male-threaded pole/device to reach various heights. Also, female thread (12) will accept a male thread (16) as part of finishing cap (13) with a hanging hole (14) to give the paintbrush a classic, finished appearance.

1 Claim, 5 Drawing Sheets

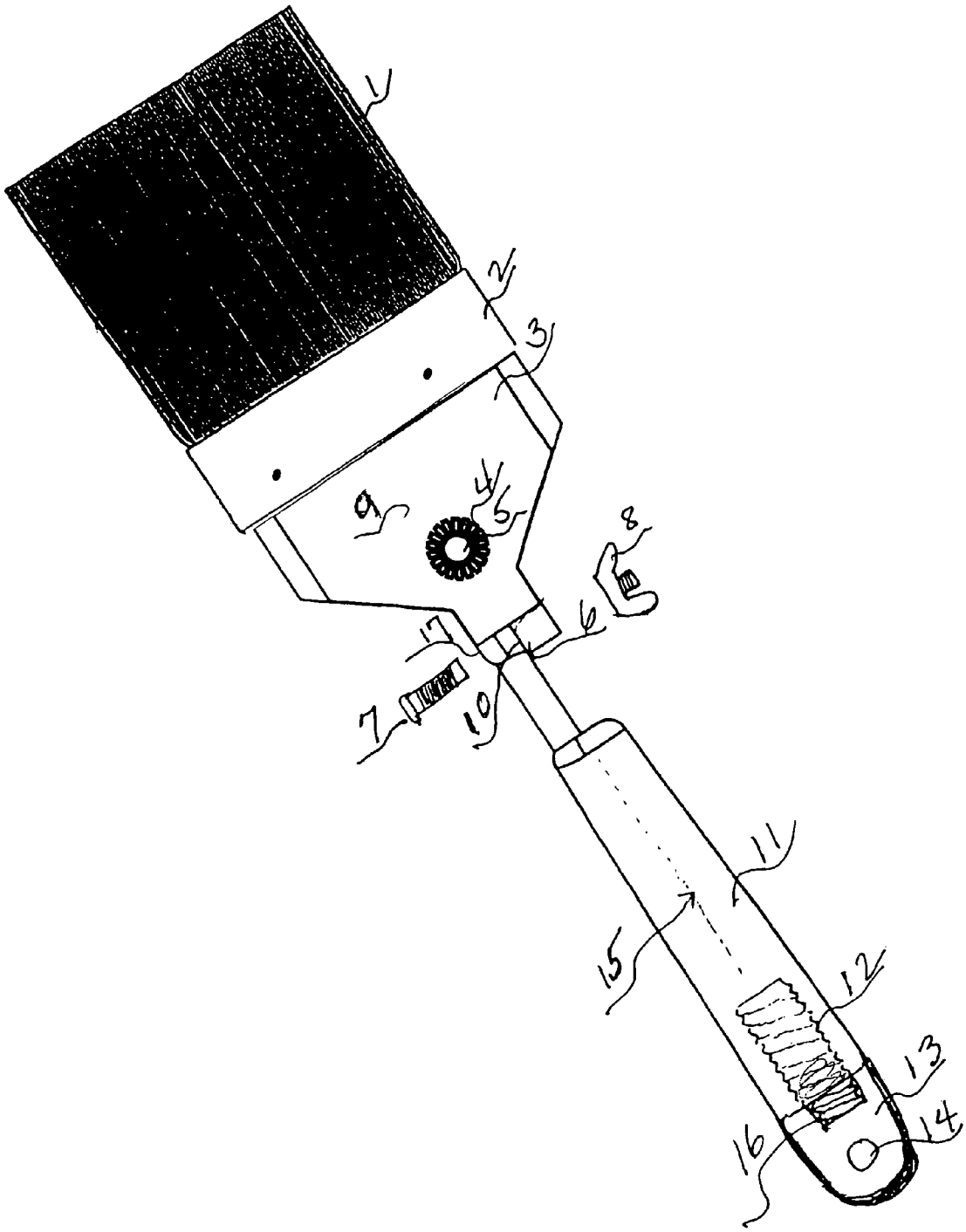
Figure #1

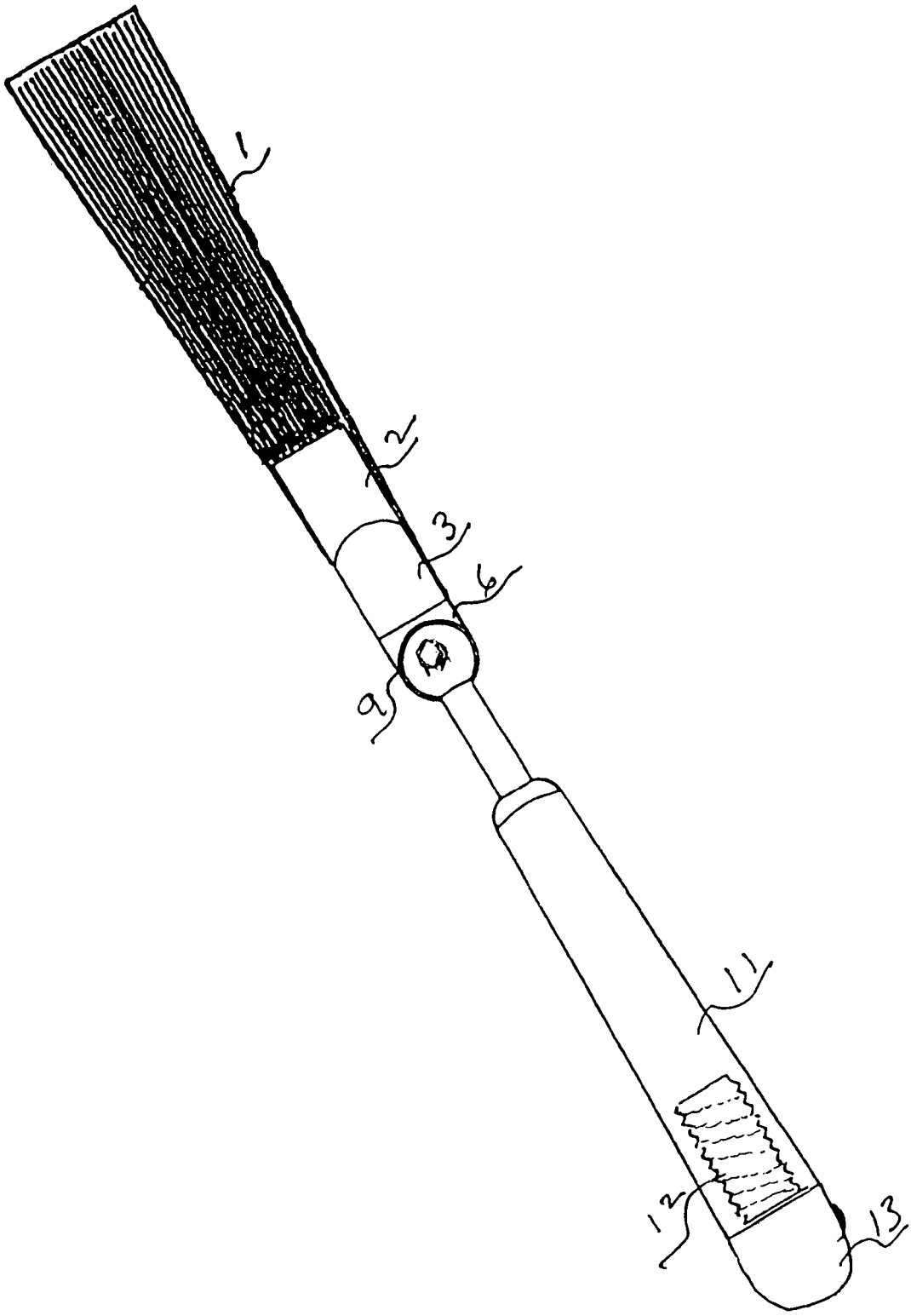
Figure #2

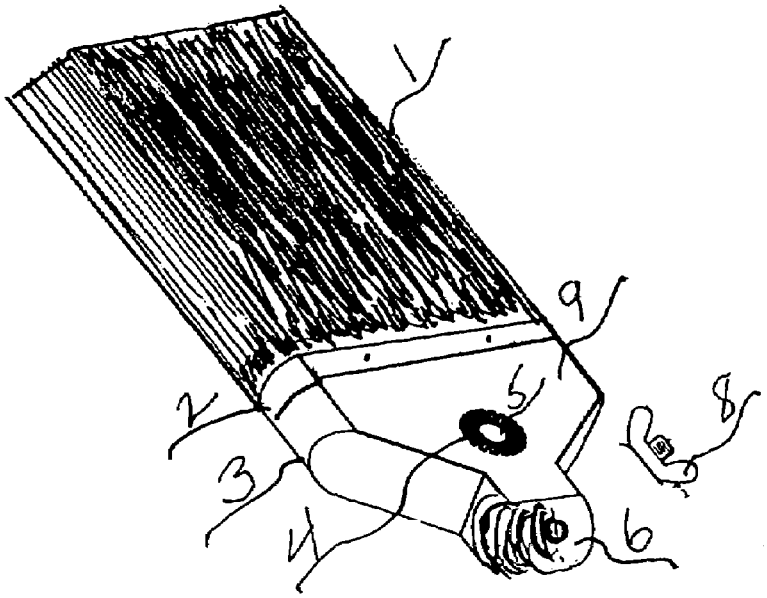
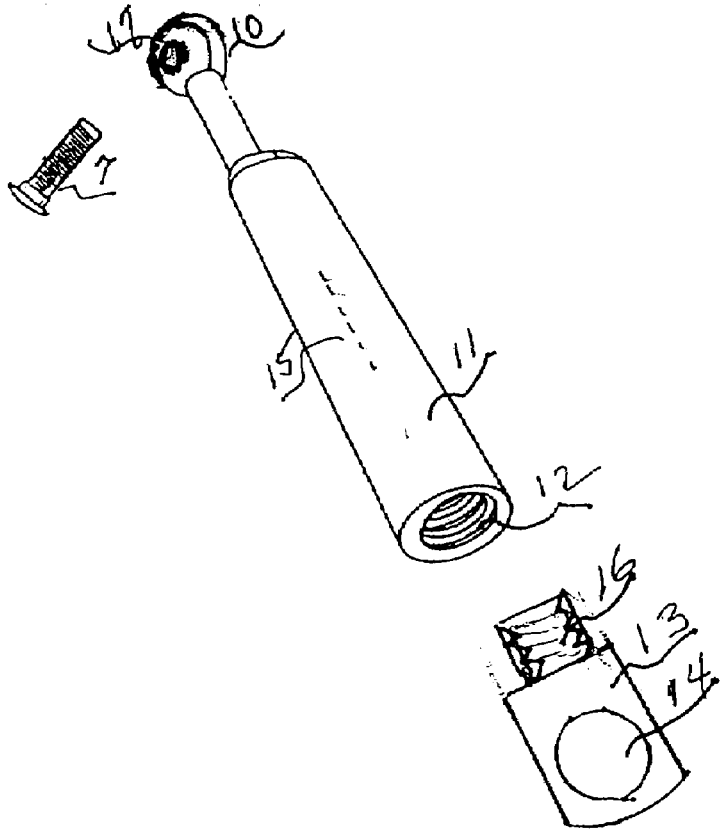
Figure #3

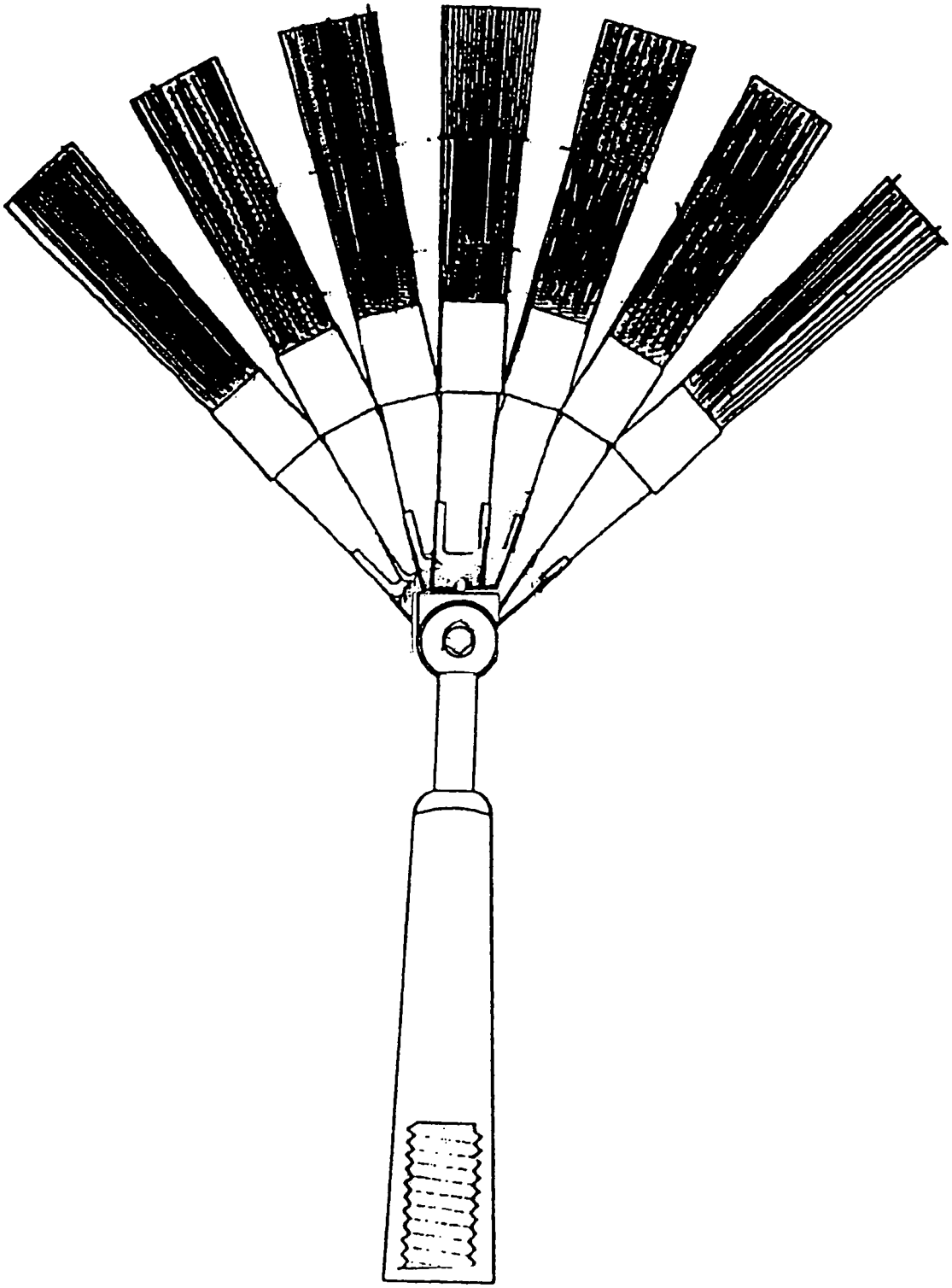
Figure #4

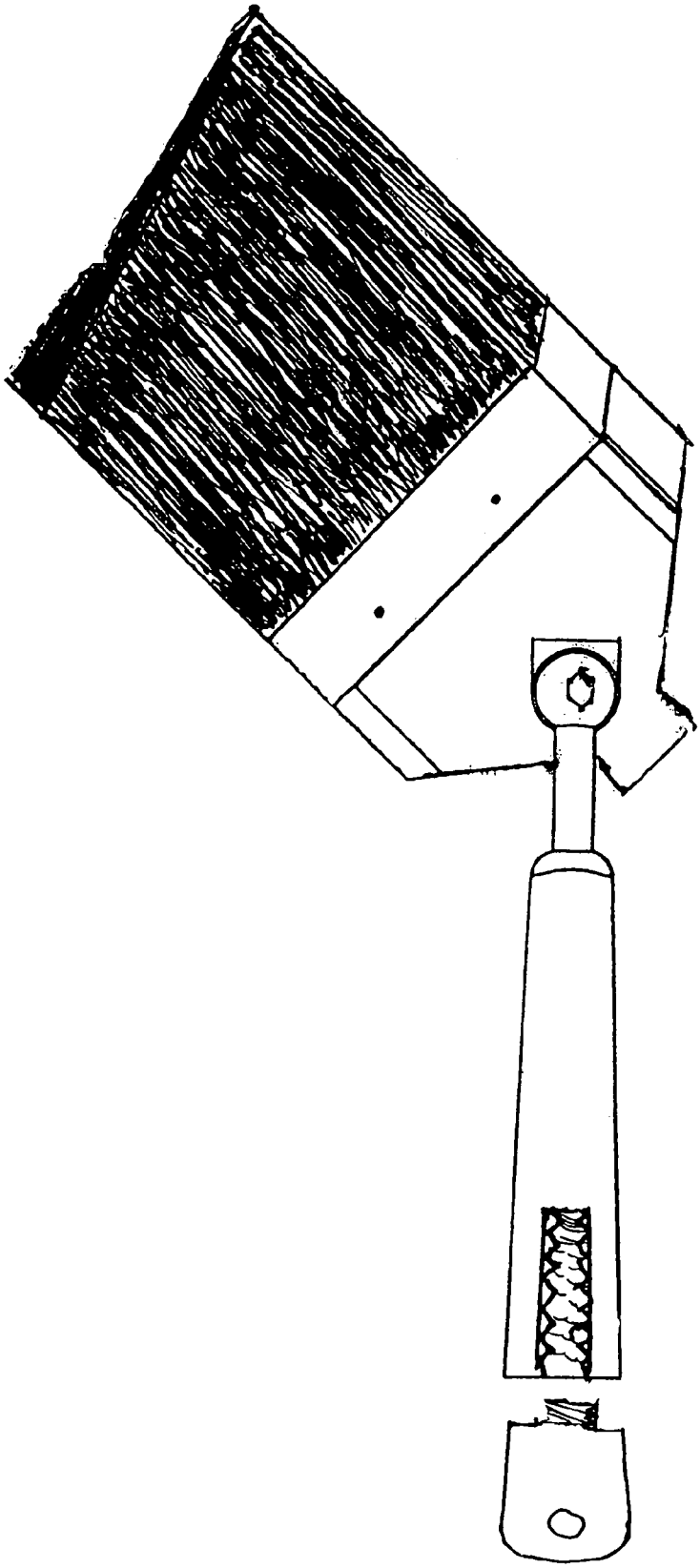
Figure #5

PAINTBRUSH WITH ADJUSTABLE HEAD

FIELD OF THE INVENTION

The present invention first appears as an average paintbrush, but a closer look reveals the unique capacity/ability of the paintbrush head to rotate one-hundred and eighty degrees (180°) through the use of a simple, one-of-a-kind male and female slip/snap locking wheel system, with the female-threaded rear/bottom of the paintbrush handle capable of receiving a universal male-threaded pole/device for extension.

BACKGROUND OF THE INVENTION

While restoring our one-hundred year old Victorian home, I, Robert Raymond Vales, was inspired with an innovative idea when I was faced with a myriad of frustrating challenges when attempting to paint high, awkward, and dangerous points inside and outside the painting area. The invention will provide professionals and everyday users of this new invention the efficient, cost-effective means of screwing a universal male-threaded pole onto the rear/bottom of a female-threaded paintbrush handle, therefore providing the ability to reach different heights and rotate the brush head one-hundred and eighty degrees (180°) through the use of the male and female slip/snap locking wheel system, with male part built directly into the tubular handle and forged into either of the two female part locations on brush head, depending on the angle necessary to reach. Thus, the need for a ladder or scaffolding is potentially eliminated, providing the user with safe and convenient working conditions on most platform surfaces when painting.

U.S. Pat. Nos. 4,751,762 to Meimeteas; 4,494,268 to Chu; 4,020,520 to Dellas; 3,214,778 to Mathison; 2,948,910 to Hulla; and 2,763,884 to Fritz depict a one-piece paintbrush that allows for no multi-rotational direction at all.

U.S. Pat. No. 4,715,080 to Rydzicki describes an attachment for holding a brush in different positions but allows for little movement in Rydzicki invention. The present invention provides a means of using a male and female rotating slip/snap locking wheel system built into said handle and forged into brush head to allow the user one-hundred and eighty degree (180°) movement in the directions said handle and brush head is locked into.

U.S. Pat. No. 5,502,859 to Kim describes a rotational paintbrush, but it contains an unstable directional wheel that if manufactured, would demonstrate its inability to lock securely into painting position. Also, in addition to the wheel, there are too many extraneous parts that would cause instability and difficulty in locking it into position. Plus, the parts and labor for this invention would prove to be much more expensive and time-consuming. These factors in Kim's invention wouldn't warrant the manufacturing of Kim's paintbrush compared to the present invention. The present invention has but to be locked together in the angle the painter so desires, using the male and female slip/snap locking wheel system to form a secure bond between female paintbrush head and male paintbrush handle.

U.S. Pat. No. 5,752,287 to Wheat depicts a paintbrush that has a rear/bottom opening on the handle and a swivel mechanism in the front to do angles in painting. This paintbrush, like the ones that came before it, is extremely unstable when motion and pressure are applied to the brush head when painting a surface or an object. Like Kim's paintbrush, there are too many parts to manufacture and assemble for his paintbrush invention to be economical. The present invention is most feasible, showing multiple paintbrush head sizes that attach with simplicity to a paintbrush handle using a simple, economical, and uncomplicated male and female slip/snap locking wheel system to form a secure bond between brush head and tubular handle, thus providing the user with safe and convenient conditions on most platforms when painting.

SUMMARY OF THE INVENTION

This present invention is a paintbrush having a handle with a longitudinal axis with a female-threaded rear/bottom opening able to receive a universal, standard male-threaded extension pole/device. On the other end of the tubular handle rests a molded male slip/snap locking wheel with protruding teeth able to turn one-hundred and eighty degrees (180°) depending on the set position of the tubular handle tightly secured by a wing nut and bolt. The brush head bottom and the brush head face of this invention each have an indented female slip/snap locking wheel forged/embedded into it enabling the handle and brush head to be locked into 2 different locations on the brush head, depending upon the angle/direction the painter so desires to reach.

It is the intention of the present invention to provide a method for the professional painter and the everyday user of this paintbrush to quickly and efficiently reach high, awkward, and dangerous locations in the painting area without the laborious set up of mechanical equipment. This ultimately creates a job that is less strenuous and less time consuming, more economical, and it reduces the risk of possible injury associated with painting from unstable platforms. Most specifically and purposefully, it allows the user to paint at various angles using the male and female slip/snap locking wheel system.

BRIEF DESCRIPTION OF THE DRAWINGS

The present invention may be more easily understood by the accompanying drawings in which:

FIG. 1 is an anterior frontal plane view of the present paintbrush invention.

FIG. 2 is a side view of FIG. 1 paintbrush invention.

FIG. 3 is a view of the component parts in FIG. 1

FIG. 4 is a side view of the present paintbrush in FIG. 1 showing the male and female slip/snap locking wheel moving paintbrush head one-hundred and eighty degrees (180°) forward and backward.

FIG. 5 is a side view of the present paintbrush handle securely attached to paintbrush head moving one-hundred and eighty degrees (180°) side to side.

DRAWING LIST OF REFERENCE NUMBERS

1—bristles (1)
2—ferrule (2)
3—brush head (3)
4—1$^{st}$ female slip/snap locking wheel recessed/embedded into brush head face (4)
5—bolt hole through center of brush head face (5)
6—2$^{nd}$ female slip/snap locking wheel recessed/embedded into brush head bottom (6)
7—bolt (7)
8—wing nut (8)
9—brush head face (9)
10—male slip/snap locking teeth handle top (10)
11—tubular handle (11)
12—female thread inside of rear/bottom handle (12)
13—male finishing cap for rear/bottom 14—paintbrush hanging hole (14)
15—longitudinal axis on handle (15)
16—protruding male thread cap rear/bottom handle (16)
17—recessed non-slip hex hole top handle (17)

DESCRIPTION OF THE PREFERRED EMBODIMENTS

Referring to the drawing by numbers of reference FIG. 1, FIG. 2 shows the paintbrush tubular handle (11) having an augured-out rear/bottom female end (12) allowing said rear/bottom to accept a universal standard male extender paint pole/device to reach various heights. The composition of the handle will be manufactured out of a plastic or other sturdy material that will be appropriate for an injection-mold process.

Referring to FIGS. 1 and 3 in the drawings, handle (11) is shown having a longitudinal axis (15) extending therealong. An upper end of the handle has a reduced diameter shank portion extending therefrom offset from a center thereof. An enlarged convex top (17) is provided on said shank portion and has a male slip/snap locking wheel thereon.

Further, brush head (3) is enclosed by a ferrule (2) with bristles (1) injected into ferrule (2) forming a paintbrush head.

Further, brush head (3) has a forged female slip snap locking wheel (6) embedded in brush head (3) bottom that will merge with handle (11) in which at its top has a male slip/snap locking wheel teeth secured by a wing nut (8) screwed onto bolt (7). Also, tubular handle top where hex bolt (7) runs through has a recessed hex hole to prevent hex bolt (7) from slipping out of place.

I claim:

1. A paintbrush comprising:

a brush head having opposite ends and defining a width and thickness, the head has opposed substantially planar side faces, a first end of the brush head is set inside a ferrule and the brush head tapers widthwise toward a second opposite end thereof, a first bolt hole passes through the planar side faces, a first slip/snap locking wheel is provided embedded on one of the side faces surrounding the first bolt hole, the second end of the brush head includes a recessed portion defining a concavity, a second bolt hole passes through the second end of the brush head from within said concavity, said second bolt hole extends substantially perpendicular to said first bolt hole, a second slip/snap locking wheel is provided embedded in said second end within said concavity and surrounds said second bolt hole;

bristles are set in and emerge from the ferrule away from said head;

an elongated tubular handle having first and second ends, the first end has a reduced diameter shank portion extending therefrom offset from a center thereof ending in an enlarged convex top, a transverse hex hole passes through said enlarged top, a third slip/snap locking wheel is provided on said enlarged top and surrounds said hex hole, said enlarged top is removably received into the concavity with the third slip/snap locking wheel engaging the second slip/snap locking wheel, a hex bolt passes through the hex hole and second bolt hole and acts in conjunction with a wing nut to secure the handle with respect to the head at a selected angle thereto, a second end of the handle has female threads extending therein;

a finishing cap has a male threaded portion received into said female threads and a hanging hole therethrough to enable hanging of the paintbrush;

wherein the handle can be selectively pivoted about 180 degrees with respect to the head about the second bolt hole, the handle can also be attached to the head to engage the first locking wheel instead of the second locking wheel and can be rotated about 180 degrees with respect to the head about the first bolt hole and selectively locked by the bolt and nut.

* * * * *